US008841977B2

(12) United States Patent
Jung et al.

(10) Patent No.: US 8,841,977 B2
(45) Date of Patent: Sep. 23, 2014

(54) PHASE SHIFTER FOR PRODUCING DIFFERENT PHASE SHIFTS THROUGH DIFFERENT PHASE VELOCITIES IN DIFFERENT LINES

(75) Inventors: Min-Seok Jung, Incheon-si (KR); Byung-Ho Kim, Seoul-si (KR)

(73) Assignee: Ace Technologies Corporation, Incheon-si (KR)

( * ) Notice: Subject to any disclaimer, the term of this patent is extended or adjusted under 35 U.S.C. 154(b) by 664 days.

(21) Appl. No.: 12/997,970

(22) PCT Filed: Jun. 17, 2009

(86) PCT No.: PCT/KR2009/003241

§ 371 (c)(1), (2), (4) Date: Dec. 14, 2010

(87) PCT Pub. No.: WO2009/157670

PCT Pub. Date: Dec. 30, 2009

(65) Prior Publication Data

US 2011/0095841 A1 Apr. 28, 2011

(30) Foreign Application Priority Data

Jun. 26, 2008 (KR) ..... 10-2008-0061213

(51) Int. Cl.
*H01P 1/18* (2006.01)

(52) U.S. Cl.
CPC . *H01P 1/18* (2013.01); *H01P 1/184* (2013.01)
USPC ..... 333/156; 333/161

(58) Field of Classification Search
CPC ..... H01P 1/18; H01P 1/184
USPC ..... 333/156, 161, 139; 342/372, 375; 343/757
See application file for complete search history.

(56) References Cited

U.S. PATENT DOCUMENTS

| | | | | |
|---|---|---|---|---|
| 5,309,166 | A * | 5/1994 | Collier et al. | 343/778 |
| 6,879,289 | B2 * | 4/2005 | Hayes | 343/700 MS |
| 7,907,096 | B2 * | 3/2011 | Timofeev et al. | 343/757 |
| 2006/0164185 | A1 * | 7/2006 | Tae et al. | 333/161 |

* cited by examiner

*Primary Examiner* — Benny Lee
(74) *Attorney, Agent, or Firm* — Duane Morris LLP

(57) ABSTRACT

A phase shifter, more particularly relates to a phase shifter for controlling phase velocity by using stubs is disclosed. The phase shifter includes a first line configured to deliver a power into corresponding radiation elements, the first line being a conductor, and a second line configured to deliver the power into corresponding radiation elements, the second line being a conductor. Here, a first phase velocity of a first signal propagated through the first line is different from a second phase velocity of a second signal propagated through the second line.

13 Claims, 9 Drawing Sheets

PHASE SHIFTER FOR PRODUCING DIFFERENT PHASE SHIFTS THROUGH DIFFERENT PHASE VELOCITIES IN DIFFERENT LINES

TECHNICAL FIELD

Example embodiment of the present invention relates to a phase shifter, more particularly relates to a phase shifter for controlling phase velocity by using stubs.

RELATED ART

A phase shifter is connected electrically to radiation elements for outputting a radiation pattern, dividing a power into the radiation elements, and electrically changing a phase. This phase shifter has a structure as shown in following FIG. 1.

FIG. 1 is a view illustrating schematically a common phase shifter, and FIG. 2 is a view illustrating connections between the phase shifter and the radiation elements. FIG. 3 is a view illustrating a process of shifting phase in the phase shifter.

In FIG. 1, the phase shifter includes a dielectric substrate 100, a first line 102, a second line 104, an input line 106, a rotation axis 108, an arm section 110 and a guide section 112.

The dielectric substrate 100 is made up of dielectric material having a specific dielectric constant, a ground plane being formed on a lower surface of the dielectric substrate 100 but is not shown.

The first line 102 is a conductor formed on the dielectric substrate 100, its ends P1 and P2 are connected electrically to a first radiation element 200A and a second radiation element 200B as shown in FIG. 2.

The second line 104 is a conductor formed on the dielectric substrate 100, its ends P3 and P4 are connected electrically to a third radiation element 200C and a fourth radiation element 200D.

The input line 106 is an input path of an RF signal. The RF signal inputted to the input line 106 is divided at the rotation axis 108, and then is propagated through a dielectric substrate area located under a lower surface of the arm section 110. Here, a third line (not shown) as a conductor is formed on the lower surface of the arm section 110. Subsequently, the RF signal propagated through the dielectric substrate area is coupled between an end of the third line and the lines 102 and 104, and then is transmitted to a corresponding radiation element. As a result, a certain radiation pattern is outputted from the radiation elements.

Hereinafter, a process of shifting phase in the phase shifter will be described in detail with reference to accompanying drawing FIG. 3.

In FIG. 3(A), a ratio of a first distance, r1, between the rotation axis 108 and the second line 104 to a second distance, r2, between the rotation axis 108 and the first line 102 is identical to the ratio of a third distance to a fourth distance. Here, the third distance is defined as a distance by which the arm section 110 is shifted on the second line 104 when the arm section 110 moves from point A to point B, and the fourth distance indicates a distance by which the arm section 110 is shifted on the first line 102 when the arm section 110 moves from point A to point B.

Generally, r2 equals to 3×r1 in FIG. 3(A), and so the arm section 110 is shifted on the first line 102 by 3β r1 when the arm section 110 is shifted on the second line 104 by β r1. Here, r1 equals to 0.16λ. Line 200A, which is coupled to end P1, has a phase shift of −3βr1, and line 200B, which is coupled to end P2, has a phase shift of +3β r1. Line 200C, which is coupled to end P3, has a phase shift of +β r1, and line 200D, which is coupled to end P4, has a phase shift of −β r1.

However, recently, a phase shifter having a wider phase shift range has been required. That is, the phase shifter where r2 has a length of above 3×r1 has been needed. For example, in that case r2 is set to have 3×r1, and the phase shifter has a structure shown in FIG. 3(B).

In FIG. 3(B), since r2 equals to 3×r1, the arm section 110 is shifted on the first line 102 by 3β r1 when the arm section 110 is shifted on the second line 104 by β r1. Line 200A, which is coupled to end P1, has a phase shift of −3βr1, and line 200B, which is coupled to end P2, has a phase shift of +3β r1. Line 200C, which is coupled to end P3, has a phase shift of +β r1, and line 200D, which is coupled to end P4, has a phase shift of −β r1.

In cases when r1 is set to have 0.25λ as shown in FIG. 3(B), the impedance of the phase shifter is matched with corresponding radiation element, i.e. load impedance, but the size of the phase shifter may be considerably increased.

In alternative methods, in cases when r1 is set to have 0.16λ (FIG. 3(A)), the phase shifter has a size similar to the phase shifter where r2 equals to 3×r1, but impedance matching with the load impedance is not realized.

The above information disclosed in this Related Art section is only to enhance the understanding of the background of the invention and therefore it may contain information that does not form the prior art that is already known in this country to a person of ordinary skill in the art.

SUMMARY OF THE INVENTION

Technical Problem

Accordingly, the present invention is provided to substantially obviate one or more problems due to limitations and disadvantages of the related art.

An example embodiment of the present invention provides a phase shifter for increasing phase shift range of a RF signal while maintaining a small size.

Technical Solution

In one aspect, the present invention provides a phase shifter comprising: a first line configured to deliver a power into a corresponding radiation element, the first line being a conductor; and a second line configured to deliver the power into the corresponding radiation element, the second line being a conductor. Here, a first phase velocity of a first signal propagated through the first line is different from a second phase velocity of a second signal propagated through the second line.

A phase shift of the first line is greater than that of the second line, and uniform first stubs are formed with a comb-line shape to the first line.

Uniform second stubs are formed with a comb-line shape to the second line, and at least one of a width of the first stub, a length of the first stub and a spacing between the first stubs is different from a width of the second stub, a length of the second stub and a spacing between the second stubs.

The first line and the second line are disposed in the same direction relative to a reference point, and a distance between the first line and the reference point is greater than that between the second line and the reference point.

The first line is disposed in a first direction relative to the reference point, and the second line is disposed in a second direction different from the first direction relative to the reference point.

Propagation constant β 1 of the first signal is different from propagation constant β 2 of the second signal.

The phase shifter further includes a rotation axis; and a first arm section is connected to the rotation axis and longitudinally extends from the rotation axis in the first direction. Here, an end of the first arm section is located on the first line.

The phase shifter further includes a second arm section longitudinally extending from the rotation axis in the second direction. Here, an end of the second arm section is located on the second line.

The ratio of a first distance between the rotation axis and the first line to a second distance between the rotation axis and the second line is different from the ratio of electrical shift distance of the first signal on the first line and electrical shift distance of the second signal on the second line.

In another aspect, the present invention provides a phase shifter comprising: a first line disposed in a first direction relative to a reference point, first stubs being formed to the first line; and a second line disposed in a second direction relative to the reference point. Here, the ratio of an electrical shift distance of a first RF signal on the first line to an electrical shift distance of a second RF signal on the second line is greater than the ratio of that of a distance between the reference point to the first line and a distance between the reference point and the second line when the phase is shifted.

The first direction is different from the second direction, and the reference point is defined as a rotation axis. The phase shifter further includes a first arm section longitudinally extending in a direction to the first line from the rotation axis; and a second arm section longitudinally extending in a direction to the second line from the rotation axis.

The first direction and the second direction are the same, and the reference point is defined as a rotation axis. The phase shifter further includes an arm section longitudinally extending in a direction to the first line and the second line from the rotation axis.

Second stubs are formed to the second line, and a width of the first stub, a length of the first stub or a spacing between the first stubs is different from a width of the second stub, a length of the second stub or a spacing between the second stubs.

Advantageous Effects

In a phase shifter of the present invention, since a stub is formed to a first line, a phase velocity of the first line may be different from that of a second line. Hence, a rate of an electrical shift distance of an arm section on the second line and a shift distance of the arm section on the first line is greater than that of a distance between a rotation axis and the second line and a distance between the rotation axis and the first line. As a result, a phase shift range of an RF signal may be increased while maintaining the size of the phase shifter.

BRIEF DESCRIPTION OF DRAWINGS

Example embodiments of the present invention will become more apparent by describing in detail example embodiments of the present invention with reference to the accompanying drawings, in which.

BEST MODE FOR CARRYING OUT THE INVENTION

Figure 1:
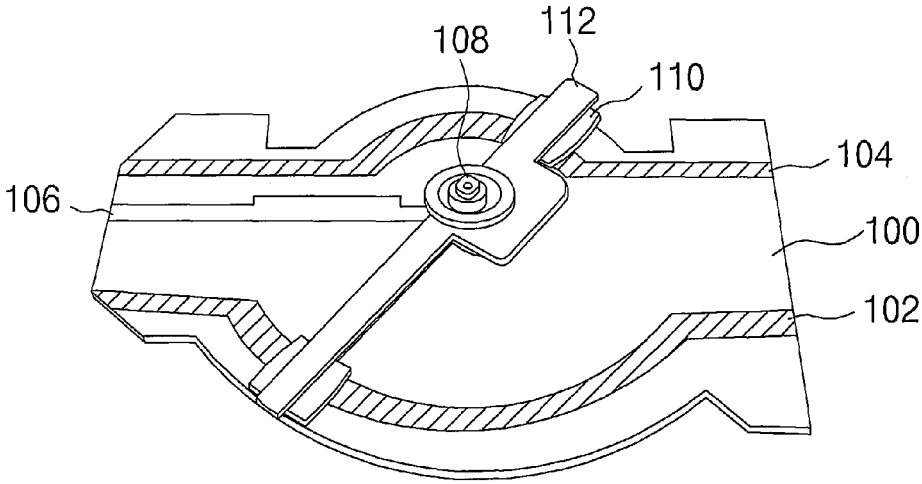
FIG. 1 RELATED ART
FIG. 1 is a view illustrating schematically a common phase shifter.
Figure 2:
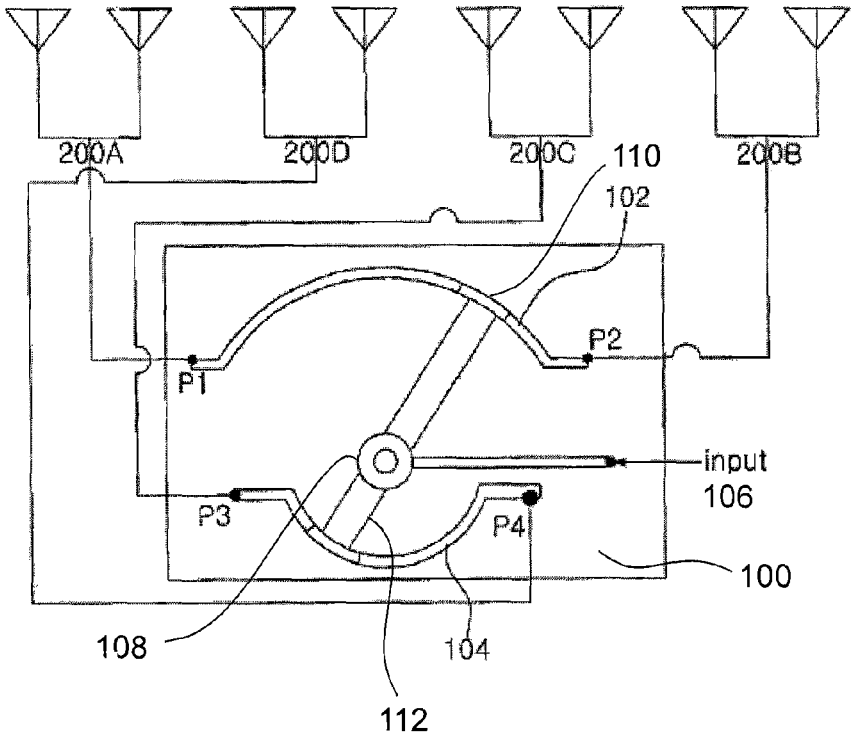
FIG. 2 RELATED ART
FIG. 2 is a view illustrating connections between the common phase shifter and the radiation elements.
Figure 3:
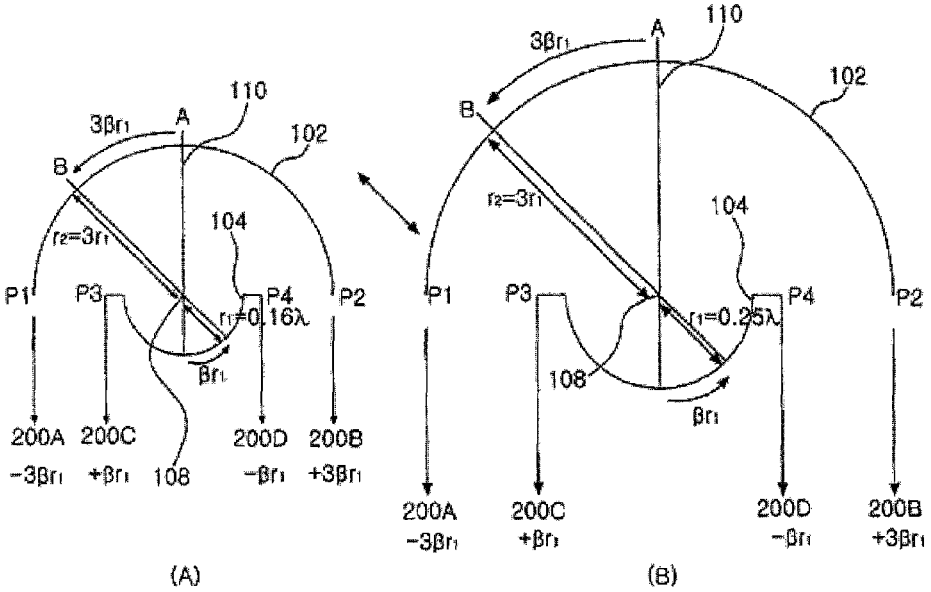
FIG. 3 RELATED ART
FIG. 3 is a view illustrating a process of shifting phase in the common phase shifter.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising, ", "includes" and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present invention will be described in detail with reference to accompanying drawings.

Figure 4:
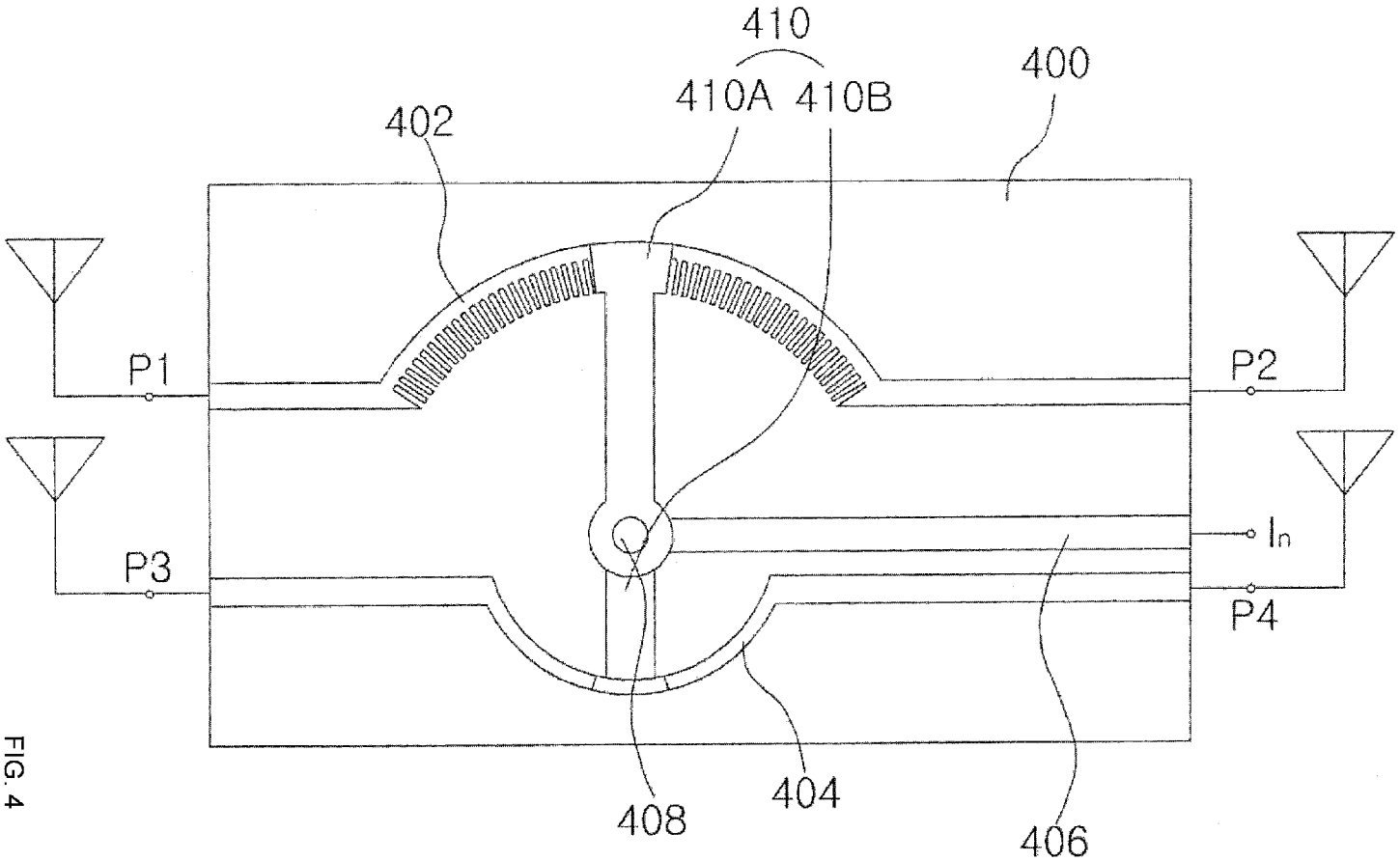
FIG. 4 is a view illustrating schematically a phase shifter according to a first embodiment of the present invention.

FIG. 4 is a view illustrating schematically a phase shifter according to a first embodiment of the present invention.

In FIG. 4, the phase shifter of the present embodiment is connected electrically to radiation elements (not shown), and divides an inputted power into the radiation elements. That is, the phase shifter changes the phase of an RF signal (power), and then transmits the changed RF signal to a corresponding radiation element, thereby controlling a radiation pattern outputted from the radiation elements.

The phase shifter includes a dielectric substrate 400, a first line 402, a second line 404, an input line 406, a rotation axis 408 and an arm section 410.

The dielectric substrate 400 is made up of dielectric material having a specific dielectric constant. In one embodiment of the present invention, a ground plane may be disposed on a lower surface of the dielectric substrate 400 or inside the dielectric substrate 400.

The first line 402 as a conductor is disposed on the dielectric substrate 400 with, for example, a curved shape, preferably arc shaped, ends P1 and P2 of the first line 402 being connected electrically to corresponding radiation elements. As a result, the RF signal propagated through the first line 402 is transmitted to the radiation elements. An input end In is also coupled to reference point 408.

In addition, stubs having a comb-line shape are formed to the first line 402 as shown in FIG. 4. The stubs increase the capacitance of the first line 402, and thus the phase velocity of the RF signal propagated through the first line 402 is reduced. Further description concerning the stubs will be described below.

In one embodiment of the present invention, the stubs are formed uniformly. In other words, the spaces between the stubs are the same, and each of the stubs has the same length and the same width. This is for shifting phase of the RF signal in proportion to shift distance of the arm section 410 irrespective of location of the arm section 410.

In the above description, each of the stubs has a rectangular shape, but the stubs may have various shapes, such as trapezoid, etc., as long as the stubs are disposed uniformly.

The second line 404 is a conductor, and is disposed with, for example, a curved shape, preferably arc shaped on the dielectric substrate 400, wherein ends P3 and P4 of the second line 404 are connected electrically to corresponding radiation elements. As a result, an RF signal propagated through the second line 404 is transmitted to the radiation elements. Here, an arc of the second line 404 has a smaller length than that of the first length 402, and so that a phase shift range of the second line 404 is less than that of the first line 402.

Unlike the first line 402, no stubs are formed to the second line 404. As a result, the total capacitance of the second line 404 is smaller than that of the first line 402, and thus a phase velocity of the second line 404 is faster than that of the first line 402. Hence, a phase shift of the RF signal propagated through the second line 404 is less than that of the RF signal propagated through the first line 402. This will be further described below.

The arm section 410 includes a major axis arm section 410A corresponding to the first line 402 and a minor axis arm section 410B corresponding to the second line 404. A third line as a conductor is disposed on a lower surface of the arm section 410. Here, the third line includes a major axis line formed on a lower surface of the major axis arm section 410A and a minor axis line formed on a lower surface of the minor axis arm section 410B. The third line rotates in the range of the arc of the line 402 or 404 in accordance with operation of the rotation axis 408.

In other words, the phase shifter is a kind of microstrip line for transmitting the RF signal to corresponding radiation elements through dielectric layers between the ground plane and the third line. Particularly, the RF signal inputted through the input line 406 is divided into the RF signal in a direction of the first line 402 and the RF signal in a direction of the second line 404 at the rotation axis 408.

The RF signal in the direction of the first line 402 is propagated through a first dielectric layer between the ground plane and the major axis line, coupled between the end of the major axis line and the first line 402, and then is transmitted to a corresponding radiation element through the first line 402.

The RF signal in the direction of the second line 404 is propagated through a second dielectric layer between the ground plane and the minor axis line, coupled between the end of the minor axis line and the second line 404, and then is transmitted to a corresponding radiation element through the second line 404.

Hereinafter, a process of shifting phase in the phase shifter will be described in detail with reference to the accompanying drawings.

Figure 5:
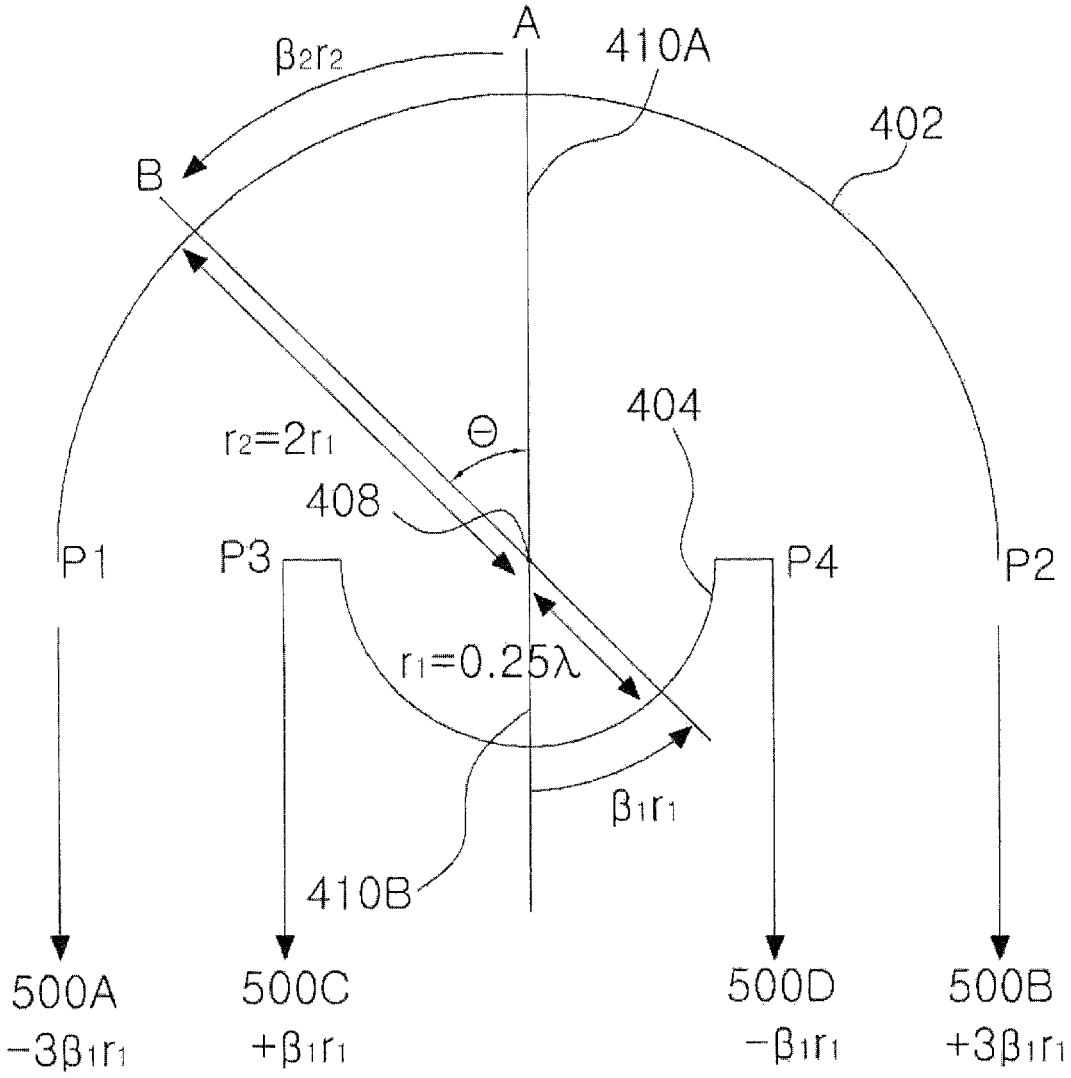
FIG. 5 is a view illustrating a process of shifting phase in the phase shifter in FIG. 4 according to one embodiment of the present invention.

FIG. 5 is a view illustrating a process of shifting phase in the phase shifter in FIG. 4 according to one embodiment of the present invention. It is assumed that one end P1 of the first line 402, other end P2 of the first line 402, one end P3 of the second line 404 and other end P4 of the second line 404 are connected to a first radiation element 500A, a second radiation element 500B, a third radiation element 500C and a fourth radiation element 500D, respectively. Additionally, it is assumed that a first distance r2 between the rotation axis 408 and the first line 402 equals to twice a second distance r1 between the rotation axis 408 and the second line 404, i.e. $r2=2\times r1$.

In FIG. 5, in case that the arm section 410 is shifted by a certain angle θ, for example the major axis arm section 410A is shifted from point A to point B, the major axis arm section 410A is shifted on the first line 402 by β 2r2. Accordingly, phase of the RF signal propagated through the first line 402 is shifted in proportion to β 2r2. Here, β 2 means a propagation constant of the first line 402.

In case that the major axis arm section 410A is shifted from point A to point B, the minor axis arm section 410B is shifted on the second line 404 by β 1r1. Accordingly, phase of the RF signal propagated through the second line 404 is shifted in proportion to β 1r1. Here, β 1 indicates propagation constant of the second line 404.

Since r2 equals to 2×r1, the phase shift of the RF signal propagated through the first line 402 is shifted in proportion to 2β 2r1. In the conventional phase shifter not including the stubs, β 1 equals to β 2, and thus the phase shift of the RF signal propagated through the first line is twice the phase shift of the RF signal propagated through the second line.

However, in the phase shifter of the present invention, β 2 may be set to have 1.5×β 1 by using the stubs, and so the phase of the RF signal propagated through the first line 402 is shifted in proportion to 3β 1r1. That is, the phase velocity of the RF signal propagated through the first line 402 is one third of the phase velocity of the RF signal propagated through the second line 404. As a result, the phase of the RF signal transmitted to the first radiation element 500A is shifted by −3β 1r1, and the phase of the RF signal transmitted to the second radiation element 500B is shifted by +3β 1r1. Moreover, the phase of the RF signal transmitted to the third radiation element 500C is shifted by +β 1r1, and the phase of the RF signal transmitted to the fourth radiation element 500D is shifted by −β 1r1.

Briefly, though the distance r2 between the rotation axis 408 and the first line 402 equals to twice the distance r1 between the rotation axis 408 and the second line 404, the phase of the RF signal propagated through the first line 402 is shifted by three times the phase of the RF signal propagated through the second line 404. The size of the conventional phase shifter for realizing three times the phase shift would be increased by 1.5 times than that of the conventional phase shifter for realizing twice phase shift. However, the phase shifter of the present invention may realize three time phase shift with the same size as the phase shifter which realizes twice phase shift.

In addition, impedance matching with the radiation elements, i.e. load impedance may be realized by setting r1 to 0.25λ.

Consequently, the phase shifter of the present embodiment may increase phase shift range while maintaining a small size.

In above description, β 2 equals to 1.5×β 1. However, β 2 may be variously set in accordance with user's objection, for example β 2 may be set to have 2×β 1.

Hereinafter, a process of changing phase velocity in accordance with the stubs will be described.

Figure 6:
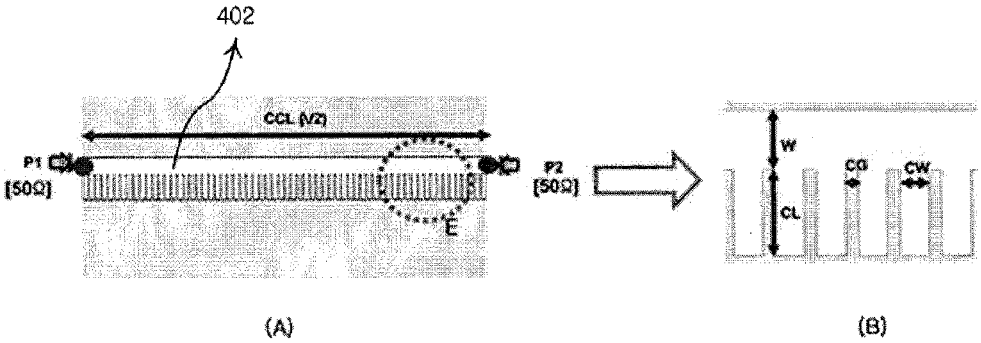
FIG. 6 is a development view illustrating stubs having a comb-line shape according to one embodiment of the present invention.
Figure 7:
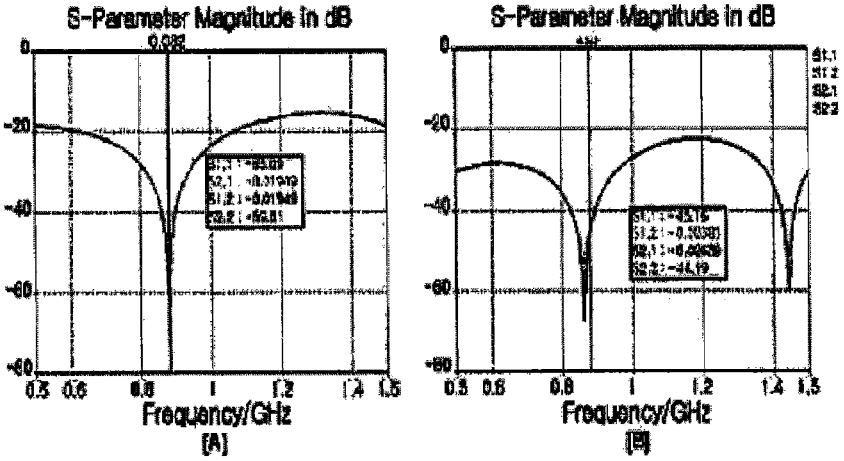
FIG. 7 to FIG. 9 are views illustrating phase velocity and impedance matching in the phase shifter having the stubs.
Figure 8:
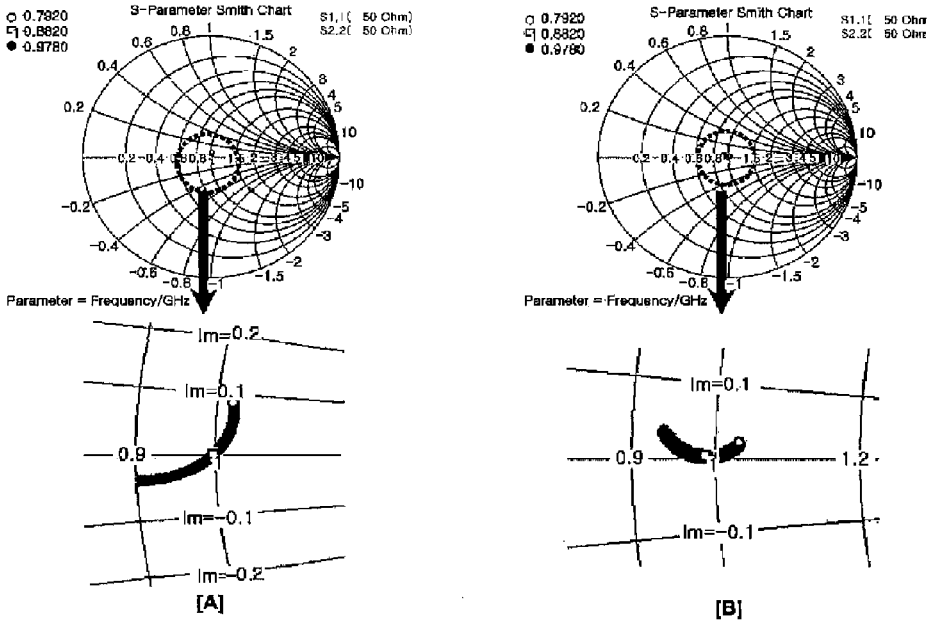
Figure 9:
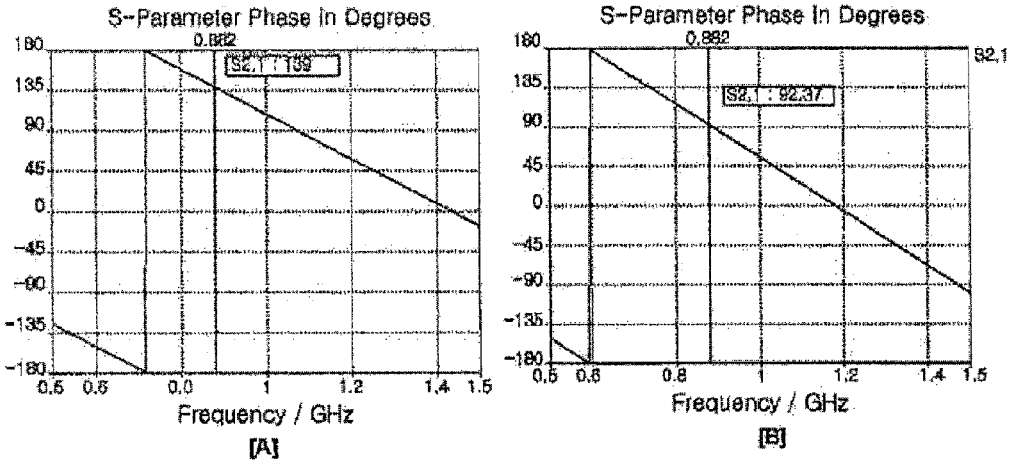

FIG. 6 is a development view illustrating stubs having a comb-line shape according to one embodiment of the present invention. FIG. 7 to FIG. 9 are views illustrating phase velocity and impedance matching in the phase shifter having the stubs.

As shown in FIG. 6(A), the stubs are formed to the first line 402 having ends P1 and P2 each with a matched impedance of 50Ω. Here, a total length CCL of the stubs is set to have λ/2. In the enlarged portion E in FIG. 6(A), it is assumed that a length of one stub, a width of one stub, space between the stubs, and a width of a part except the stubs of the first line 402 are assumed as CL, CW, CG and W, respectively, as shown in FIG. 6(B).

In this case, the phase velocity of the first line 402 is expressed as the following Expression 1.

$$\text{Phase velocity } (vp) = \lambda Ef = \frac{1}{\sqrt{L(C + \frac{C_0}{(CG + CW)}}}, \quad \text{[Expression 1]}$$

where L is an inductance of the first line 402, C is a capacitance of the first line 402, and $C_0$ indicates capacitance of unit stub.

Referring to Expression 1, the phase velocity of the first line 402 becomes slow due to the stubs. As a result, the phase shift for a unit length of the first line 402 to which the stubs are formed is greater than that for a unit length of the second line 404 to which stubs are not formed.

Hereinafter, experimental results about resonance frequency, characteristic impedance and phase shift will be described. Here, the thickness of the dielectric substrate 400 is assumed to be 1.524 mm, and the relative dielectric constant of the dielectric material ∈ r in the dielectric substrate 400 is assumed to be 3.0. In addition, the phase shifter is used for realizing resonance frequency in the range of 806 MHz to 960 MHz.

Experimental Example 1

| W | CL | CW | CG | CCL |
|---|---|---|---|---|
| 2.3 mm | 3.3 mm | 1.2 mm | 0.5 mm | 109 mm |

Experimental Example 2

| W | CL | CW | CG | CCL |
|---|---|---|---|---|
| 1.5 mm | 5.5 mm | 0.3 mm | 1.3 mm | 109 mm |

FIGS. 7(A) and 7(B) illustrate a Scattering Parameters chart which illustrate power versus frequency in GHz. A resonance frequency in the example 1 has 0.882 GHz as shown in FIG. 7(A), and a resonance frequency in the example 2 is 0.870 GHz as shown in FIG. 7(B). That is, the user realizes a resonance frequency in the range of the desired frequency band with respect to power.

FIGS. 8(A) and 8(B) illustrate S-parameter Smith charts and charts of frequency. A person of ordinary skill in the art will understand that a Smith chart displays data related transmission in a graphical format by mapping a complex rectangular impedance plane into a polar system that represents complex reflection coefficients. In FIGS. 8(A) and 8(B) the phase shift ratio described previously is represented in a polar system. The characteristic impedance of the first line 402 of FIG. 5 has approximately 50Ω, and is matched with the impedance to corresponding radiation element, i.e. load impedance as shown in FIG. 8, which illustrates a phase velocity and impedance matching in the stubs of the phase shifter.

Referring to FIGS. 9(A) and 9(B), which are graphs of phase versus frequency in GHz of the Examples 1 and 2, respectively, the phase in the example 1 is shifted by 139° at the frequency of 0.882 GHz, and the phase in the example 2 is shifted by 92.37° at the frequency of 0.882 GHz.

In short, referring to the examples 1 and 2, the desired resonance frequency and impedance matching are realized by forming the stubs to the first line 402, and phase shift range is varied according as setting of the stubs is changed.

In other words, the phase shifter of the present embodiment adjusts the phase shift range by controlling the phase velocity using the stubs. Accordingly, the phase shifter may realize a wider phase shift range while maintaining its size through a method of forming properly the stubs to the first line 402.

Figure 10:
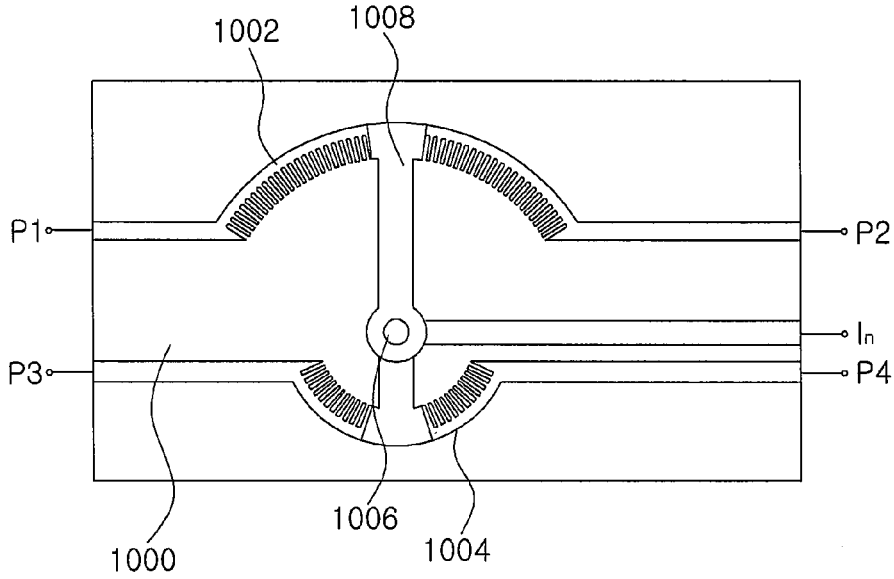
FIG. 10 is a view illustrating schematically a phase shifter according to a second embodiment of the present invention.

FIG. 10 is a view illustrating schematically a phase shifter according to a second embodiment of the present invention.

In FIG. 10, the phase shifter of the present embodiment includes a dielectric substrate 1000, a first line 1002, a second line 1004, a rotation axis 1006 and an arm section 1008. Input In and output lines P1-P4 describe the circuit flow.

Since the other elements of the present embodiment, except the lines 1002 and 1004, are the same as in the phase shifter of the first embodiment, any further description concerning the same elements will be omitted.

First stubs having a comb-line shape are formed to the first line 1002 as shown in FIG. 10, and second stubs having a comb-line shape are formed to the second line 1004. Here, a length (or width) of the first stub is different from that of the second stub. Additionally, a spacing between the first stubs may be different from a spacing between the second stubs.

That is, to realize the phase shifter where the first line 1002 and the second line 1004 have different phase velocities, the first stub and the second stub are designed so that they have a different length, width or spacing. As a result, a distance between the rotation axis 1006 and the second line 1004 and a distance between the rotation axis 1006 and the first line 1002 may be different from that of electrical shift distance of a RF signal on the second line 1004 and electrical shift distance of a RF signal on the first line 1002.

Referring to the first embodiment and the second embodiment, the stubs are formed with a comb-line shape to the first line having longer arc. Here, stubs may not be formed to the second line having shorter arc or may be formed with a comb-line shape to the second line. In cases when the stubs are formed to the first line and the second line, the stubs formed to the first line have a different structure from the stubs formed to the second line.

Figure 11:
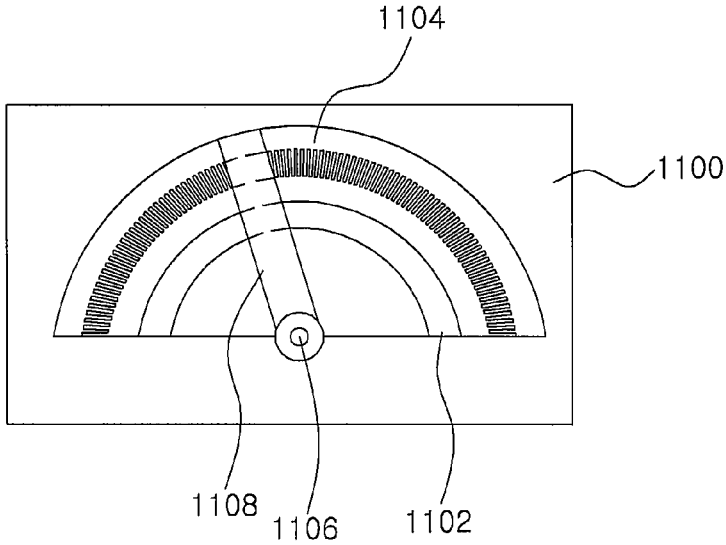
FIG. 11 is a view illustrating a phase shifter according to a third embodiment of the present invention.
Figure 12:
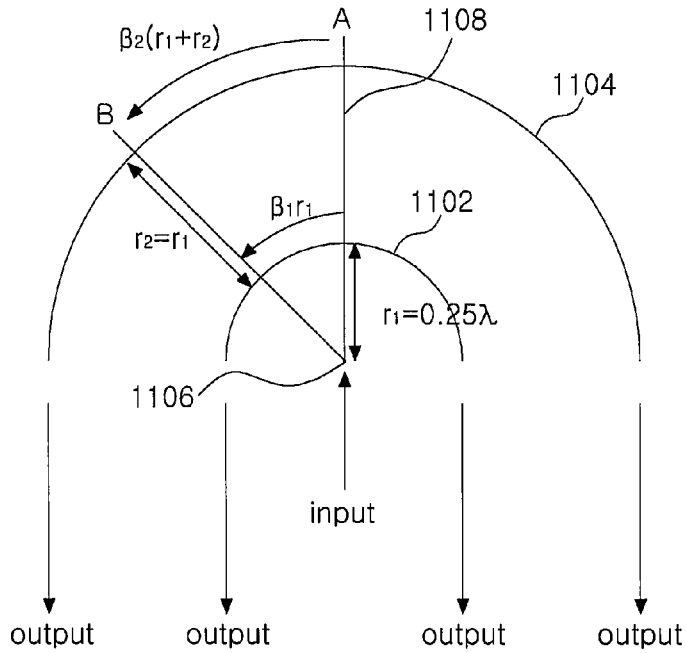
FIG. 12 is a view illustrating schematically phase shift of the phase shifter in FIG. 11.

FIG. 11 is a view illustrating a phase shifter according to a third embodiment of the present invention, and FIG. 12 is a view illustrating schematically a phase shift of the phase shifter in FIG. 11. In FIG. 12, an input signal is received at 1106 and four output signals "output" are generated in response with each output being coupled to a respective end of line 1104 or line 1108.

In FIG. 11, the phase shifter of the present embodiment includes a dielectric substrate 1100, a first line 1102, a second line 1104, a rotation axis 1106 and an arm section 1108.

Unlike the first embodiment and the second embodiment where the first line and the second line are disposed in different directions relative to the rotation axis, the first line 1102 and the second line 1104 in the present embodiment are disposed in the same direction relative to the rotation axis 1106. To realize a different phase velocity, stubs are formed with comb line shape to the second line 1104 having longer arc. In this case, stubs may not be formed to the first line 1102 or may be formed to the first line 1102.

Hereinafter, a process of shifting phase in the phase shifter will be described in detail with reference to accompanying drawing FIG. 12. Here, a distance between the rotation axis 1106 and the first line 1102 is assumed to be r1, and distance between the first line 1102 and the second line 1104 is assumed to be r2.

In cases when the arm section 1108 is shifted from point A to point B, the arm section 1108 is shifted on the first line 1102 by $\beta$ 1r1 in view of an electrical length, and is shifted on the second line 1104 by $\beta$ 2(r1+r2) in view of an electrical length. If r1 equals to r2, the phase of an RF signal propagated through the second line 1104 is shifted in proportion to 2$\beta$ 2r1, and the phase of an RF signal propagated through the first line 1102 is shifted in proportion to $\beta$ 1r1. Hence, in cases when $\beta$ 2 equals to 1.5×$\beta$ 1, the phase shift of the RF signal propagated through the second line 1104 is three times phase shift of the RF signal propagated through the first line 1102. In other words, the phase velocity of the RF signal propagated through the second line 1104 is a third of phase velocity of the RF signal propagated through the first line 1102. As a result, the phase of an RF signal transmitted to a first radiation element connected to one terminal of the second line 1104 is shifted by −3$\beta$ 1r1, and the phase of an RF signal transmitted to a second radiation element connected to the other terminal of the second line 1104 is shifted by +3$\beta$ 1r1. In addition, the phase of an RF signal transmitted to a third radiation element connected to one terminal of the first line 1102 is shifted by +$\beta$ 1r1, and the phase of an RF signal transmitted to a fourth radiation element connected to the other terminal of the first line 1102 is shifted by −$\beta$ 1r1.

In the above description, $\beta$ 2 is set to have 1.5×$\beta$ 1. However, $\beta$ 2 may be variously changed in accordance with user's objection.

Referring to the first embodiment to the third embodiment, the first line and the second line may be disposed in the same direction or in different directions. The phase shifters control the phase velocity of corresponding RF signal using the stubs irrespective of disposition direction of the first line and the second line, and so the phase shifter may realize a wider phase shift range while maintaining its size.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A phase shifter comprising:

a first line configured to deliver a power into a corresponding radiation element, the first line being a conductor; and a second line configured to deliver the power into a corresponding radiation element, the second line being a conductor, wherein a first phase velocity of a first signal propagated through the first line is different from a second phase velocity of a second signal propagated through the second line, a phase shift range of the first signal propagated through the first line is proportional to a phase shift range of the second signal propagated through the second line, a ratio of a first phase shift to a second phase shift is different from a ratio of a distance between a reference point and the first line to a distance between the reference point and the second line, the first phase shift is defined as a phase shift of the first signal propagated through the first line, and the second phase shift is defined as a phase shift of the second signal propagated through the second line.

2. The phase shifter of claim 1, wherein a phase shift of the first line is higher than a phase shift of the second line, and uniform first stubs are formed with a comb line shape to the first line.

3. The phase shifter of claim 2, wherein uniform second stubs are formed with a comb line shape to the second line, and at least one of a width of the first stub, a length of the first stub and a spacing between the first stubs is respectively different from a width of the second stub, a length of the second stub and a spacing between the second stubs.

4. The phase shifter of claim 2, wherein the first line and the second line are disposed in the same direction relative to the reference point, and a distance between the first line and the reference point is greater than a distance between the second line and the reference point.

5. The phase shifter of claim 2, wherein the first line is disposed in a first direction relative to the reference point, and the second line is disposed in a second direction different from the first direction relative to the reference point.

6. The phase shifter of claim 1, wherein a propagation constant $\beta$ 1 of the first signal propagated through the first line is different from a propagation constant β 2 of the second signal propagated through the second line.

7. The phase shifter of claim 1, further comprising:

a rotation axis; and a first arm section connected to the rotation axis, and longitudinally extends from the rotation axis in a first direction relative to the rotation axis, wherein an end of the first arm section extends to a location on the first line.

8. The phase shifter of claim 7, further comprising:

a second arm section longitudinally extends from the rotation axis in a second direction, wherein an end of the second arm section extends to a location on the second line.

9. The phase shifter of claim 7, wherein a ratio of a first distance to a second distance is different from a ratio of an electrical shift distance of the first signal on the first line to an electrical shift distance of the second signal on the second line, and wherein the first distance is defined as a distance between the rotation axis and the first line, and the second distance is defined as a distance between the rotation axis and the second line.

10. A phase shifter comprising:

a first line disposed in a first direction relative to a reference point, first stubs being formed to the first line; and a second line disposed in a second direction relative to the reference point, wherein a ratio of a first electrical shift distance of a first RF signal on the first line to a second electrical shift distance of a second RF signal on the second line is greater than a ratio of a distance between the reference point and the first line to a distance between the reference point and the second line when phase is shifted, the electrical shift distance of the first RF signal propagated through the first line is proportional to electrical shift distance of the second RF signal propagated through the second line when the phase is shifted, the first electrical shift distance is defined as an electrical shift distance of a first RF signal propagated through the first line, and the second electrical shift distance is defined as an electrical shift distance of a second RF signal propagated through the second line.

11. The phase shifter of claim 10, wherein the first direction is different from the second direction, and the reference point is defined as a rotation axis, the phase shifter further comprising:

a first arm section longitudinally extended in a direction to the first line from the rotation axis; and a second arm section longitudinally extended in a direction to the second line from the rotation axis.

12. The phase shifter of claim 10, wherein the first direction and the second direction are the same, and the reference point is defined as a rotation axis, the phase shifter further comprising:

an arm section longitudinally extended in a same direction relative to the first line from the rotation axis.

13. The phase shifter of claim 10, wherein second stubs are formed to the second line, and a width of the first stub, a length of the first stub or a spacing between the first stubs is respectively different from a width of the second stub, a length of the second stub or a spacing between the second stubs.

* * * * *